US008747091B2

(12) United States Patent
Noguchi

(10) Patent No.: US 8,747,091 B2
(45) Date of Patent: Jun. 10, 2014

(54) WATER INJECTION TYPE SCREW COMPRESSOR

(75) Inventor: Toru Noguchi, Kako-gun (JP)

(73) Assignee: Kobe Steel, Ltd., Kobe-shi (JP)

( * ) Notice: Subject to any disclaimer, the term of this patent is extended or adjusted under 35 U.S.C. 154(b) by 211 days.

(21) Appl. No.: 13/329,888

(22) Filed: Dec. 19, 2011

(65) Prior Publication Data

US 2012/0201710 A1 Aug. 9, 2012

(30) Foreign Application Priority Data

Feb. 8, 2011 (JP) ..... 2011-025117

(51) Int. Cl.

| | |
|---|---|
| ***F01C 21/04*** | (2006.01) |
| ***F01C 21/06*** | (2006.01) |
| ***F03C 2/00*** | (2006.01) |
| ***F03C 4/00*** | (2006.01) |
| ***F04C 2/00*** | (2006.01) |
| ***F04C 15/00*** | (2006.01) |
| ***F04C 27/02*** | (2006.01) |
| ***F04C 29/02*** | (2006.01) |
| ***F04C 29/04*** | (2006.01) |
| ***F01C 1/16*** | (2006.01) |
| ***F01C 1/24*** | (2006.01) |
| ***F04C 18/00*** | (2006.01) |
| ***F01C 21/00*** | (2006.01) |
| ***F04C 29/00*** | (2006.01) |

(52) U.S. Cl.

USPC ..... 418/201.1; 418/85; 418/88; 418/89; 418/99; 418/100; 418/270; 418/DIG. 1

(58) Field of Classification Search

USPC ..... 418/85, 88, 89, 99, 100, 201.1, 270, 418/DIG. 1

See application file for complete search history.

(56) References Cited

U.S. PATENT DOCUMENTS 4,758,138 A * 7/1988 Timuska ..... 418/100
4,968,231 A * 11/1990 Zimmern et al. ..... 418/1

(Continued)

FOREIGN PATENT DOCUMENTS

JP 2001-342982 12/2001
JP 2007-162484 6/2007

(Continued)

OTHER PUBLICATIONS

Machine Translation JP 2009-108696 Done Aug. 5, 2013.*

(Continued)

*Primary Examiner* — Theresa Trieu
*Assistant Examiner* — Dapinder Singh
(74) *Attorney, Agent, or Firm* — Oblon, Spivak, McClelland, Maier & Neustadt, L.L.P.

(57) ABSTRACT

A water injection type screw compressor wherein gas sucked from an intake flow is supplied to a rotor chamber, compressed and discharged into a discharge channel as compressed fluid together with water supplied to the rotor chamber, comprises a water separator disposed in the discharge channel to separate water and gas from compressed fluid, a water channel connecting the water separator to a compressor main body for supplying the rotor chamber with the water separated in the water separator, and an oil circulation channel including an oil pump, an oil filter, and a housing for storing oil for supplying the oil to where lubrication is needed. Further, a part of the water channel is arranged passing through an oil trap formed at the bottom inside the housing for storing oil. Thus, oil temperature increases can be minimized in simplified structure having no oil cooling means such as an oil cooler.

2 Claims, 6 Drawing Sheets

(56) References Cited

U.S. PATENT DOCUMENTS

| | | | | | |
|---|---|---|---|---|---|
| 5,121,607 | A | * | 6/1992 | George, Jr. | 60/712 |
| 5,195,881 | A | * | 3/1993 | George, Jr. | 418/97 |
| 5,199,858 | A | * | 4/1993 | Tsuboi et al. | 417/362 |
| 5,241,817 | A | * | 9/1993 | George, Jr. | 60/39.182 |
| 6,095,780 | A | * | 8/2000 | Ernens | 418/104 |
| 6,461,112 | B1 | | 10/2002 | Ohta et al. | |
| 7,040,882 | B2 | * | 5/2006 | Segers et al. | 418/201.1 |
| 7,993,110 | B1 | * | 8/2011 | Hill | 417/251 |
| 2008/0253914 | A1 | * | 10/2008 | Kubota et al. | 418/104 |
| 2010/0233004 | A1 | * | 9/2010 | Matsuzaka et al. | 418/84 |
| 2011/0123379 | A1 | * | 5/2011 | Saga et al. | 418/26 |
| 2013/0183203 | A1 | * | 7/2013 | Watanabe et al. | 422/170 |

FOREIGN PATENT DOCUMENTS

| | | | |
|---|---|---|---|
| JP | 2009-108696 | * | 5/2009 |
| KR | 10-0345843 | * | 7/2002 |
| KR | 10-2009-0042731 | | 4/2009 |

OTHER PUBLICATIONS

Machine Translation KR 10-0345843 Done Aug. 5, 2013.*

U.S. Appl. No. 13/398,097, filed Feb. 16, 2012, Noguchi.

Notice of Preliminary Rejection issued May 22, 2013 in Korean Patent Application No. 10-2012-12203 (with English translation).

* cited by examiner

WATER INJECTION TYPE SCREW COMPRESSOR

BACKGROUND OF THE INVENTION

1. Field of the Invention

The present invention relates to water injection type screw compressors including a pair of intermeshing male and female screw rotors and using water in place of oil as a liquid coolant.

2. Description of the Related Art

Conventionally, as compressors which compress a gas such as air for use as compressed gas, so-called oil cooled compressors (oil cooled screw compressors) have often been used. In such an oil cooled compressor, it is necessary to prevent increases in temperature of compressed air or other components resulting from heat generated during compression, and seal gaps between machine elements, such as screw rotors and a rotor casing, in a compression working space which is a region to generate compressed air. Due to the necessities, oil is introduced into the compression working space where compression is in progress, and supplied to a speed increasing gear unit or roller bearings.

Typically, in the compressors of the oil cooled type, an apparatus for separating an oil component, such as an oil separator, is additionally provided in a flow channel on a discharge side. Specifically, although compressed gas that contains the oil component is discharged from the oil cooled compressor, the oil component is removed in the above-described apparatus for separating an oil component, such as the oil separator, to thereby provide the compressed gas containing no oil component to a device in which the compressed gas is supplied.

In practice, however, there is a great difficulty in completely removing the oil component. Therefore, the oil cooled compressors cannot be used in factories, such as food factories, pharmaceutical factories, precision machine factories, etc. where a supply of clean, oil free compressed air is required. For this reason, water injection type compressors (water lubricated compressors) which use water in place of oil have been suggested (refer to, for example, JP 2007-162484 A), and they are becoming widely used.

Because the compressed air generated by the water injection type compressor includes no oil component, the water injection type compressor can be used even in the factories that need clean compressed air. However, in a case where the water injection type compressor is a so-called screw compressor, when male and female screw rotors housed in a compression space of that water injection type screw compressor are made of metal, it is not possible to directly engage the male and female screw rotors with each other even under a condition that water is supplied to the compression space. This is because a viscosity of water is lower than that of oil.

Thus, in a typical water injection type screw compressor, timing gears are mounted on end regions of the male and female screw rotors to rotate the screw rotors by means of the timing gears while maintaining a gap between the male and female screw rotors. The timing gears, a speed increasing gear unit, and bearings for supporting the screw rotors (such as roller bearings) cannot be lubricated with water, and instead should be lubricated with oil. As a scheme for lubricating the components such as the timing gears with oil, an oil bath system for storing oil in a housing that includes the components such as the timing gears and at least partially soaking the component in the oil, or a forced circulation system for forcibly circulating oil through the components may be employed.

On the other hand, for the purpose of reducing (eliminating the need for) lubrication with oil in the water lubricated screw compressor, it is necessary to use the screw rotors, which are formed of resin and allowed to directly engage with each other even in an environment where water having a low viscosity is present, to employ a water lubricated slide bearing as a bearing for supporting the screw rotors, and to take other measures.

However, the water lubricated screw compressors have problems as described below. For example, in a type requiring oil lubrication of components such as the timing gears, when the number of rotations of the timing gears or other components is increased in the above-described oil bath system, an agitation loss becomes greater. Such a greater agitation loss produces an increase in oil temperature, resulting in poor lubrication or a reduced life of lubrication oil. In addition, because the oil is not exchanged in the above type, if a foreign object is introduced, it is not easy to remove the foreign object.

On the other hand, in the above-described forced circulation system, the agitation loss such as that occurs in the oil bath system is small because oil is forcibly circulated by means of an oil circulating pump or the like. Further, an oil filter can be attached at some midpoint of a pipe through which the oil is circulated, to thereby supply the timing gears and other components with clean oil at any time, which secures a higher degree of reliability as compared to the oil bath system. It is however necessary that a cooling means, such as an oil cooler, should be inserted in an oil circulating channel to suppress the increase in oil temperature. Thus, the forced circulation system still has room for improvement in terms of a downsizing of equipment, reduction in cost, and the like.

Moreover, even the water lubricated screw compressor of the type arranged to reduce (eliminate the need for) the lubrication with oil has a problem as described below. That is, the screw rotor formed of resin has a liner expansion coefficient which is higher than that of a screw rotor formed of metal, and thus tends to expand while absorbing water over time. This requires a relatively greater gap to be previously defined between the male and female screw rotors, resulting in a low degree of compression efficiency. Meanwhile, the water lubricated slide bearing, which typically has a clearance greater than that of a ball bearing, is inferior in performance as a bearing, and might not be suitably resistant to wear. In general, a combination of the resin screw rotors and the water lubricated slide bearing is more expensive than a combination of the metallic screw rotors and the ball bearing, which also leaves room for improvement in terms of cost reduction.

Therefore, it is an object of the present invention to provide water lubricated screw compressors, in particular, a water lubricated screw compressor of a type which requires oil lubrication for components in a forced lubrication system, the structure of the water lubricated screw compressor being simplified by eliminating an oil cooling means such as an oil cooler, while an increase in oil temperature is minimized.

SUMMARY OF THE INVENTION

To address the need, the present invention advantageously provides a water injection type screw compressor in which a sucked gas is compressed and discharged together with water as a compressed fluid, comprising a casing in which a rotor chamber is formed, a pair of male and female screw rotors which are rotatably housed in the rotor chamber to compress the gas supplied in the rotor chamber through rotation of the screw rotors, a drive motor for causing the screw rotors to rotate, a discharge channel for allowing the gas compressed in the rotor chamber to flow therethrough, a water separator disposed in the discharge channel to separate water and the gas from the compressed fluid, a water channel which connects the water separator to a main body of the compressor to supply the water separated in the water separator to the rotor chamber, and an oil circulation channel in which an oil pump, an oil filter, and a housing for storing oil are disposed for supplying the oil to where lubrication is required. Further, in the water injection type screw compressor, a part of the water channel passes through an oil trap formed at a bottom region inside the housing for storing oil.

According to the thus structured water injection type screw compressor, because the part of the water channel passes through the oil trap formed at the bottom region inside the housing for storing oil, it becomes unnecessary to install an oil cooling means which has conventionally been needed. In other words, it becomes possible to implement the screw compressor of a water lubricated type whose structure can be simplified by eliminating the oil cooling means such as an oil cooler while minimizing an increase in oil temperature.

The thus structured water injection type screw compressor of this invention may further comprise intermeshing timing gears mounted on end regions of the male and female screw rotors, in which the timing gears may be retained at a top region inside a timing gear case coupled to the casing, and the housing for storing oil may be arranged as the timing gear case. According to the above-described structure, a separate and independent oil tank becomes unnecessary, which can contribute to further simplification of structure.

The thus structured water injection type screw compressor of this invention may further comprise a speed increasing gear unit composed of intermeshing main and pinion gears which are respectively mounted on an screw rotor end of one of the male screw rotor or the female screw rotor and on an end region of a motor shaft for the drive motor, in which the speed increasing gear unit may be retained at a top region inside a speed increasing gear unit case coupled to the casing, and the housing for storing oil may be arranged as the speed increasing gear unit case. The above-described structure can also eliminate the need for the separate and independent oil tank, and contribute to further structural simplification.

In the thus structured water injection type screw compressor of this invention, a flow direction of the oil in the oil trap may be oriented in a direction substantially opposed to a flow direction of water in the part of the water channel that passes through the oil trap. According to the above-described structure, cooling efficiency can be enhanced due to favorable heat exchange between the oil in the oil trap and the water flowing through the water channel.

The thus structured water injection type screw compressor of this invention may further comprise a partitioning plate shaped member which is substantially horizontally placed between the timing gears and the oil trap in the housing for storing oil, in which an opening may be formed between one end of the partitioning plate shaped member and an inner wall surface of the housing for storing oil, and an oil discharge port may be formed in the housing at a bottom of the oil trap located below the other end of the partitioning plate shaped member. Further, in the water injection type screw compressor, the part of the water channel passing through the oil trap may be formed by a through pipe conduit which is substantially horizontally placed in the oil trap. According to the above-described structure, in the course of a travel toward the oil discharge port, drain oil dropped into the oil trap is directed to flow in the direction substantially opposite to that of the cooling water, which can facilitate heat exchange between the drain oil and the cooling water, and in turn enhance cooling efficiency.

DESCRIPTION OF THE PREFERRED EMBODIMENTS

Figure 1:
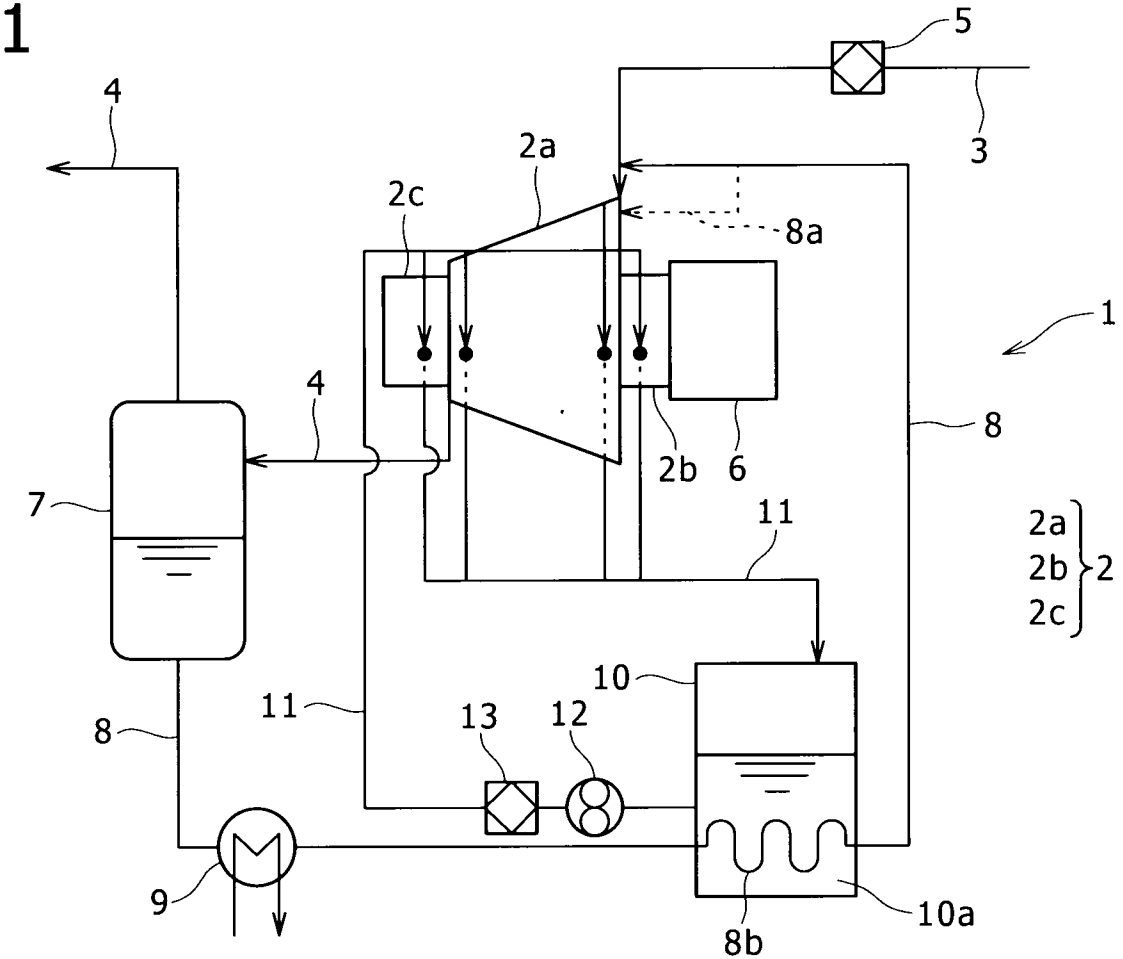
FIG. 1 is a schematic system diagram showing a water injection type screw compressor according to a first embodiment of this invention.

Now, a water injection type screw compressor according to a first embodiment of this invention is described with reference to FIG. 1 in the accompanying drawings. FIG. 1 is a schematic system diagram of the water injection type screw compressor according to the first embodiment of this invention.

The water injection type screw compressor 1 according to the first embodiment of this invention includes a casing 2 in which a rotor chamber (not illustrated) is formed. Then, a screw rotor of a drive side (male type) and a screw rotor of a driven side (female type) which will be described below are engaged with each other and rotatably housed in the rotor chamber. In other words, a compressor main body is composed of the casing 2 in which the rotor chamber is formed and the male and female screw rotors rotatably housed in the rotor chamber.

Then, one end of the rotor chamber is connected to an intake channel 3 from which a gas to be compressed is sucked, while the other end of the rotor chamber is connected to a discharge channel 4 from which the gas having been compressed is discharged. Further, an intake filter 5 is installed in the intake channel 3. Moreover, the casing 2 is broadly divided into a main body case 2*a* where the above-described rotor chamber is formed, a speed increasing gear unit case 2*b* positioned on an intake channel 3 side of the main body case 2*a*, and a timing gear case 2*c* positioned on a discharge channel 4 side of the main body case 2*a*. In addition, a motor casing 6 is connected to one end surface of the speed increasing gear unit case 2*b* which lies on the side opposite to the other end surface of the speed increasing gear unit case 2*b* connected to the main body case 2*a*.

In the speed increasing gear unit case 2*b*, the rotor shaft (not illustrated) for the screw rotor of the drive side (male type) is extended into its inside, and a pinion gear, one of speed increasing gears, which will be described below, is mounted on the rotor shaft for the screw rotor of the drive side (male type) extended into the speed increasing gear unit case 2*b*. A main gear, the other of the speed increasing gears engaged with the pinion gear is also rotatably housed. The main gear in the speed increasing gears is connected to an end region of a motor rotor shaft (not illustrated) for a motor rotor housed in the motor casing 6.

In the timing gear case 2*c*, on the other hand, both the rotor shaft (not illustrated) for the screw rotor of the drive side (male type) and a rotor shaft (not illustrated) for the screw rotor of the driven side (female type) are extended in its inside, and the above-described timing gear is mounted on each end of the rotor shafts.

Here, rotation of the motor rotor shaft for the motor rotor is transferred via a speed increasing gear unit (the speed increasing gears) housed in the speed increasing gear unit case 2*b* to the rotor shaft of the drive side (male type) screw rotor. Then, rotation of the rotor shaft for the drive-side (male type) screw rotor is transferred via the timing gears housed in the timing gear case 2*c* to the rotor shaft for the driven-side (female type) screw rotor. The drive-side (male type) screw rotor and the driven-side (female type) screw rotor are rotated under an intermeshed condition while maintaining a small gap therebetween (i.e. without directly contacting to each other).

That is, in the water injection type screw compressor 1, the rotation of the male and female screw rotors causes a gas sucked from the intake channel 3 to be compressed inside the rotor chamber and discharged to the discharge channel 4 as a compressed fluid together with water supplied into the rotor chamber. It should be noted that each of the male and female screw rotors is supported on its rotor shaft by a plurality of bearings mainly composed of roller bearings. An arrangement for supplying water to the rotor chamber will be described further below.

A water recovery unit (a water separator) 7 for separating the compressed gas and water from the compressed fluid discharged through the discharge channel 4 to recover the water is inserted in the discharge channel 4. A water channel 8 which is in communication with the intake channel 3 or a water channel 8*a* (indicated by a dotted line in the figure) which is in communication with a compression working space of the rotor chamber where compression is in progress is extended from a lower part of the water recovery unit 7. The water channel 8 includes a water cooler 9 for cooling water that passes therethrough and an oil tank 10 which is a housing for storing oil. Further, at a part of the water channel 8, part which penetrates the oil tank 10, a through pipe conduit 8*b*, which penetrates an oil trap 10*a* formed at a bottom region inside the oil tank 10, is formed.

Moreover, the water injection type screw compressor 1 further comprises an oil circulation channel 11 for supplying oil to portions which need to be lubricated. The above-described oil tank 10, an oil pump 12 for outputting the oil, and an oil filter 13 which captures impurities from the oil passing therethrough for purification are installed in the oil circulation channel 11. The above-described oil trap 10*a* is formed at the bottom region inside the oil tank 10. In the oil circulation channel 11, the oil is supplied from the oil trap 10*a* at the bottom region inside the oil tank 10 via the oil pump 12 and the oil filter 13 to the portions which need to be lubricated, in particular, the bearings for supporting the male and female screw rotors, the timing gears, the speed increasing gear unit, and the like. After passing through the portions which need to be lubricated, the oil is returned through the oil circulation channel 11 again to the oil tank 10. So, the oil is repeatedly circulated in the oil circulation channel 11.

The compressed fluid discharged into the discharge channel 4 and thus the water separated in the water recovery unit 7 are raised to considerably high temperatures. Thus, because it is necessary to cool the water separated in the water recovery unit 7 before supplying the water again to the rotor chamber, the above-described water cooler 9 is provided. In the water injection type screw compressor 1 according to the first embodiment of this invention, however, a part of the water channel 8 in which the water cooled by the water cooler 9 flows is arranged to pass through the oil trap 10*a* in the oil tank 10 before the water channel 8 is connected to the rotor chamber. In this way, an oil cooling means such as an oil cooler which has conventionally been needed becomes unnecessary. In other words, the screw compressor 1 of the water lubricated type can be implemented, in which an increase in oil temperature can be minimized while simplifying structure without having to provide the oil cooling means such as an oil cooler.

Figure 2:
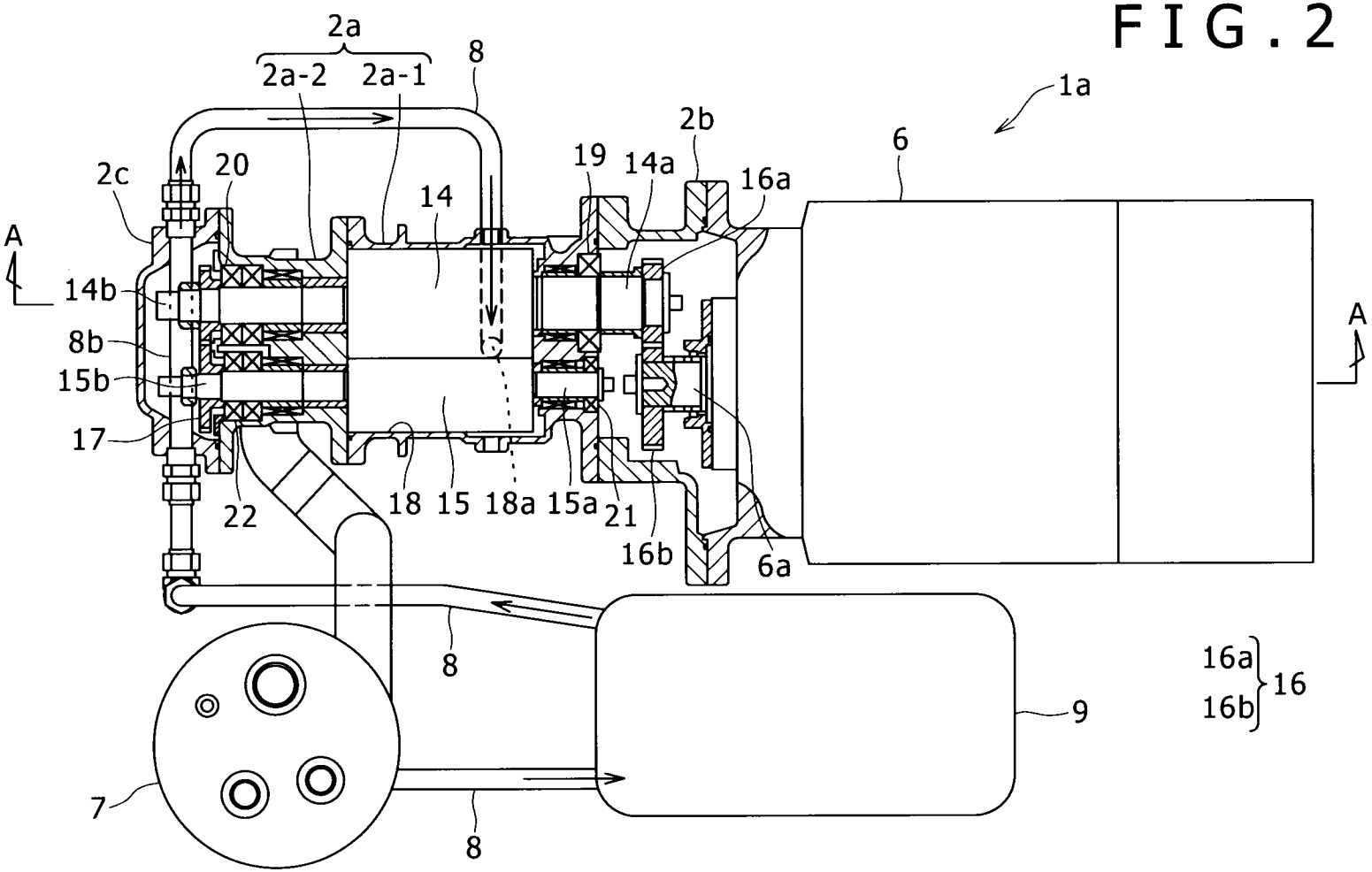
FIG. 2 is a plan view showing, partially in cross section, structure of a water injection type screw compressor according to a second embodiment of this invention.
Figure 3:
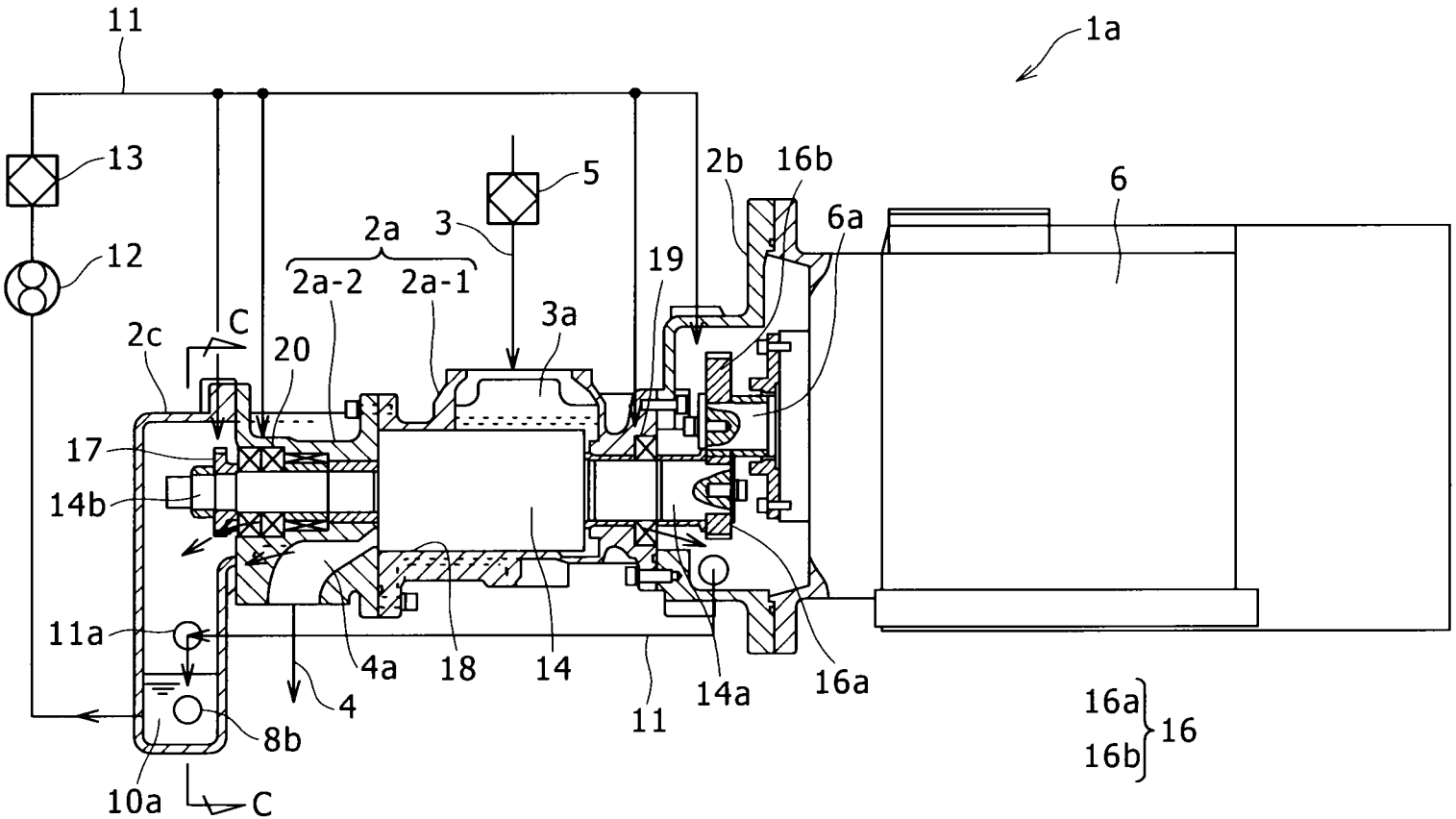
FIG. 3 is a schematic diagram viewed along an arrow A-A of FIG. 2 according to the second embodiment of this invention in which a schematic oil circulation channel is additionally depicted.

Next, a water injection type screw compressor according to a second embodiment of this invention will be described with reference to FIGS. 2 and 3 in the accompanying drawings. FIG. 2 is a plan view showing, partially in cross section, structure of the water injection type screw compressor according to the second embodiment of this invention, and FIG. 3 is a schematic diagram viewed along an arrow A-A of FIG. 2 according to the second embodiment of this invention in which a schematic oil circulation channel is additionally depicted.

Structure of the water injection type screw compressor 1*a* according to the second embodiment of this invention has a lot in common with that of the water injection type screw compressor 1 according to the previously-described first embodiment of this invention. However, although the oil tank 10 which is separate and independent of the timing gear case 2*c* is installed in the water injection type screw compressor 1 of the first embodiment of this invention, the oil tank 10 is not provided in the water injection type screw compressor 1*a* according to the second embodiment of this invention, and the timing gear case 2*c* also functions as the housing for storing oil instead.

Further, an oil trap 10*a* is formed in the bottom region inside the timing gear case 2*c*, and the through pipe conduit 8*b* in which a part of the water channel 8 is arranged to pass therethrough is formed in the oil trap 10*a*. Besides, various structural details which are not illustrated in FIG. 1 are shown in FIGS. 2 and 3. Hereinafter, referring to FIGS. 2 and 3 in the accompanying drawings, the detailed structure of the water injection type screw compressor 1*a* according to the second embodiment of this invention will be described with the inclusion of much content that overlaps with the description about the water injection type screw compressor 1 shown in FIG. 1 according to the first embodiment of this invention.

The water injection type screw compressor 1*a* according to the second embodiment of this invention includes the casing 2 in which the rotor chamber 18 is formed. Further, both the screw rotor 14 of the drive side (male type) and the screw rotor 15 of the driven side (female type) are rotatably housed in the rotor chamber 18. That is, the compressor main body is composed of the casing 2 in which the rotor chamber 18 is formed and the male and female screw rotors 14, 15 rotatably housed in the rotor chamber 18.

Also provided are the intake channel connected to one side of the rotor chamber 18, i.e. an intake port 3*a* and the discharge channel 4 connected to the other side of the rotor chamber 18, i.e. a discharge port 4*a*. Moreover, the intake filter 5 is included in the intake channel 3. The casing 2 is broadly divided into the main body case 2*a* in which the above-described rotor chamber 18 is formed, the speed increasing gear unit case 2*b* located on the intake channel 3 side of the main body case 2*a*, and the timing gear case 2*c* located on the discharge channel 4 side of the main body case 2*a*. The motor casing 6 is connected to one end surface of the speed increasing gear unit case 2*b* which is on the opposite side of the other end surface of the speed increasing gear unit case 2*b* connected to the main body case 2*a*. Here, the main body case 2*a* is composed of the rotor chamber 18, a rotor casing 2*a*-1 including the intake port 3*a* and other components, and a discharge casing 2*a*-2 including the discharge port 4*a* and other components.

In the speed increasing gear unit case 2*b*, the rotor shaft 14*a* for the screw rotor 14 of the drive side (male type) is extended, while the pinion gear 16*a*, one of the speed increasing gears 16 is mounted on the end region of the rotor shaft 14*a* for the screw rotor 14 of the drive side (male type) extended into the speed increasing gear unit case 2*b*. Further, the main gear 16*b*, the other of the speed increasing gears 16 is engaged with the pinion gear 16*a* and mounted on the end part of the motor rotor shaft 6*a* for the motor rotor housed in the motor casing 6.

In the timing gear case 2*c*, on the other hand, both the rotor shaft 14*b* for the screw rotor 14 of the drive side (male type) and the rotor shaft 15*b* for the screw rotor 15 of the driven side (female type) are extended. The timing gear 17 is mounted on each end of the rotor shafts 14*b* and 15*b*. Then, rotation of the motor rotor shaft 6*a* for the motor rotor is transferred via the speed increasing gear unit 16 (the speed increasing gears 16*a*, 16*b*) housed in the speed increasing gear unit case 2*b* to the rotor shaft 14*a* for the screw rotor 14 of the drive side (male type), and rotation of the rotor shaft 14*a* (i.e. the rotor shaft 14*b*) is transferred via the timing gears 17 housed in the timing gear case 2*c* to the rotor shaft 15*b* for the screw rotor 15 of the driven side (female type).

Then, the screw rotor 14 of the drive side (male type) and the screw rotor 15 of the driven side (female type) are rotated in an intermeshed condition while maintaining a small gap therebetween (without allowing direct contact between the screw rotors 14 and 15). In the water injection type screw compressor 1*a*, the rotation of the male and female screw rotors 14, 15 causes the gas sucked from the intake channel 3 is compressed inside the rotor chamber 18 and discharged as the compressed fluid to the discharge channel 4 together with the water supplied in the rotor chamber 18. It should be noted that the male and female screw rotors 14 and 15 are supported on their respective rotor shafts 14*a*, 14*b* and 15*a*, 15*b* by a plurality of bearings 19, 20, 21, and 22 mainly composed of roller bearings. Meanwhile, the arrangement to supply water into the rotor chamber 18 will be described further below.

The water recovery unit 7 for separating the compressed gas and the water from the compressed fluid discharged through the discharge channel 4 to recover the water is inserted in the discharge channel 4. The water recovery unit 7 is equipped with the water channel 8 extended from the lower part of the water recovery unit 7 and directed to communicate with the compression working space 18*a* of the rotor chamber 18 where compression is in progress. The water cooler 9 for cooling water that passes therethrough and the timing gear case 2*c* are installed in the water channel 8. Note that a part of the water channel 8, penetrating the timing gear case 2*c* functioning as the housing for storing oil, is constructed as the through pipe conduit 8*b* that passes through the oil trap 10*a* formed at the bottom region inside the timing gear case 2*c*.

An oil level of the oil trap 10*a* formed at the bottom region inside the timing gear case 2*c* is defined to lie below a lower end of the timing gears 17 housed at a top region inside the timing gear case 2*c*. In other words, the oil level of the oil trap 10*a* is maintained at a sufficiently low level to ensure that the timing gears 17 and the bearings 20, 22 are not soaked in the oil trap 10*a*. Meanwhile, the through pipe conduit 8*b* passing through the oil trap 10*a* formed in the bottom region inside the timing gear case 2*c* is formed of a copper pipe of a standardized product which is inserted into the timing gear case 2*c*, secured at both ends thereof by means of thermocouple joints, and sealed to prevent the oil from flowing out of the timing gear case 2*c*.

In addition, the water injection type screw compressor 1*a* further includes the oil circulation channel 11 for supplying the oil to the portions which need to be lubricated. The above-described timing gear case 2*c*, the oil pump 12 for capturing impurities from the oil that passes therethrough and outputting the oil, and the oil filter 13 for purifying the oil are installed in the oil circulation channel 11.

The oil is supplied from the oil trap 10*a* at the bottom region inside the timing gear case 2*c* via the oil filter 13 and the oil pump 12 to the portions which need to be lubricated, specifically, the bearings 19, 20, 21, 22 for supporting the male and female screw rotors, the timing gears 17, the speed increasing gear unit 16, and other components while flowing through the oil circulation channel 11. After passing through the portions to be lubricated, the oil is gathered in the oil trap 10*a* at the bottom region inside the timing gear case 2*c*. Then, the oil delivered from the oil trap 10*a* is again circulated through the oil circulation channel 11 to lubricate the bearings 19, 21 disposed on a speed increasing gear unit case 2*b* side.

The compressed fluid discharged into the discharge channel 4 and therefore the water separated in the water recovery unit 7 are raised to considerably high temperatures. It is therefore necessary to cool the water separated in the water recovery unit 7 before supplying the water again to the rotor chamber 18. For this reason, the above-described water cooler 9 is installed. However, the water injection type screw compressor 1*a* is provided, in the oil trap 10*a* of the timing gear case 2*c* which functions as the housing for receiving the timing gears 17 and also functions as the housing for storing oil, with the through pipe conduit 8*b* in which a part of the water channel 8 is substantially horizontally placed and directed to pass therethrough before supplying the rotor chamber 18 with the water having been cooled by the water cooler 9.

In this way, the oil cooling means which has conventionally been needed is no longer necessary. That is, the screw compressor 1*a* of the water lubricated type capable of suppressing the increase in oil temperature while having structure simplified by eliminating the oil cooling means such as an oil cooler can be implemented. Here, the description "substantially horizontally placed" refers to a condition that the through pipe conduit 8*b* is oriented in substantially horizontal position only at its inlet part entering the oil trap 10*a* and at its outlet part exiting from the oil trap 10*a*, but does not necessarily mean that a piping route in between the inlet and outlet parts is arranged straightly. Thus, the piping route may be, for example, a meandering path as shown in FIG. 1.

Further, although the water injection type screw compressor 1 according to the first embodiment includes the oil tank 10 which is separate and independent of the timing gear case 2*c*, the oil tank 10 does not exist in the water injection type screw compressor 1*a* according to the second embodiment in which the oil trap 10*a* is formed at the bottom region inside the timing gear case 2*c* instead, and the through pipe conduit 8*b* is arranged within the oil trap 10*a* so as to pass therethrough in the substantially horizontal position. Therefore, there is no need for installing the separate and independent oil tank, which can contribute to further structural simplification.

Figure 4:
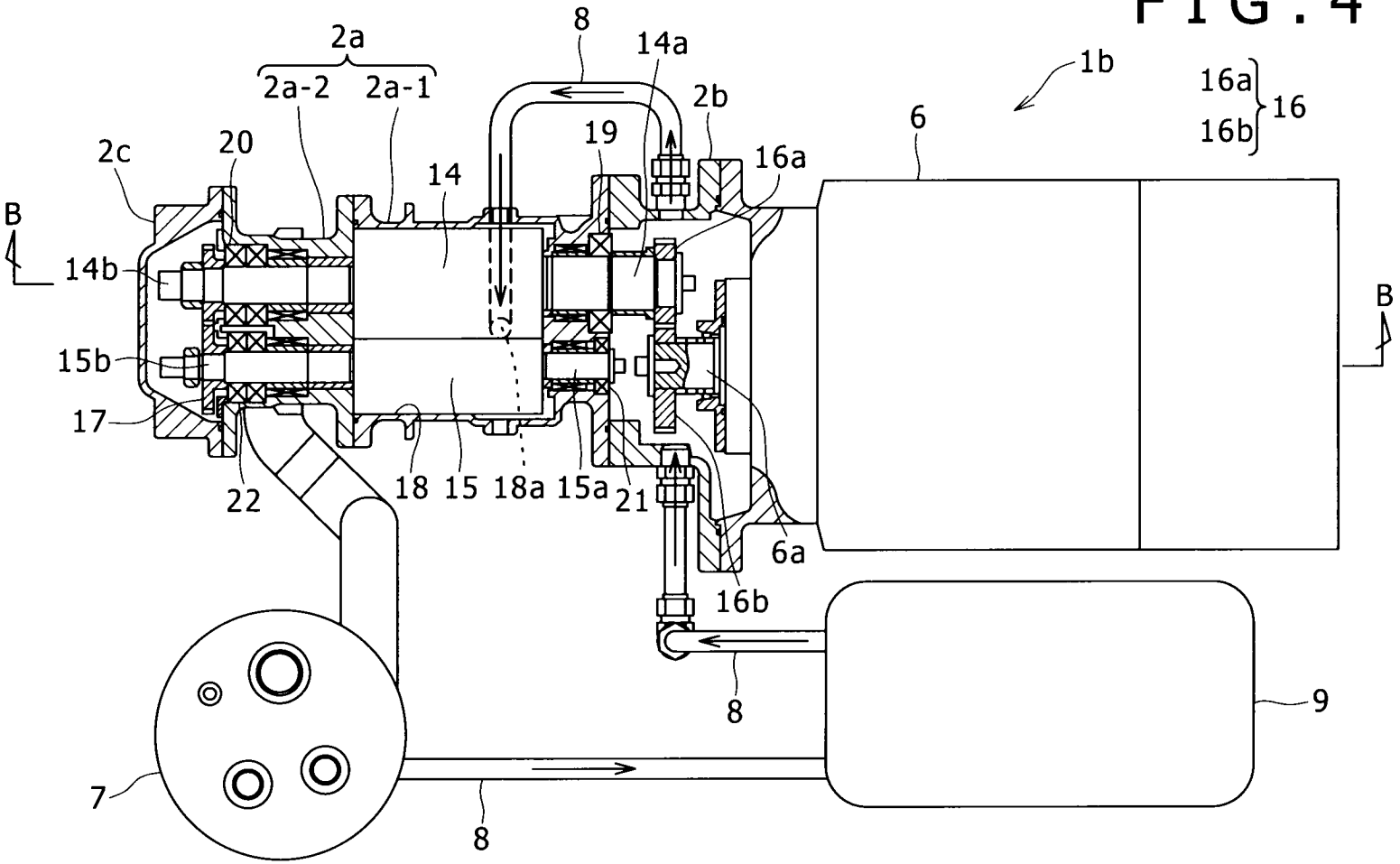
FIG. 4 is a plan view showing, partially in cross section, structure of a water injection type screw compressor according to a third embodiment of this invention.
Figure 5:
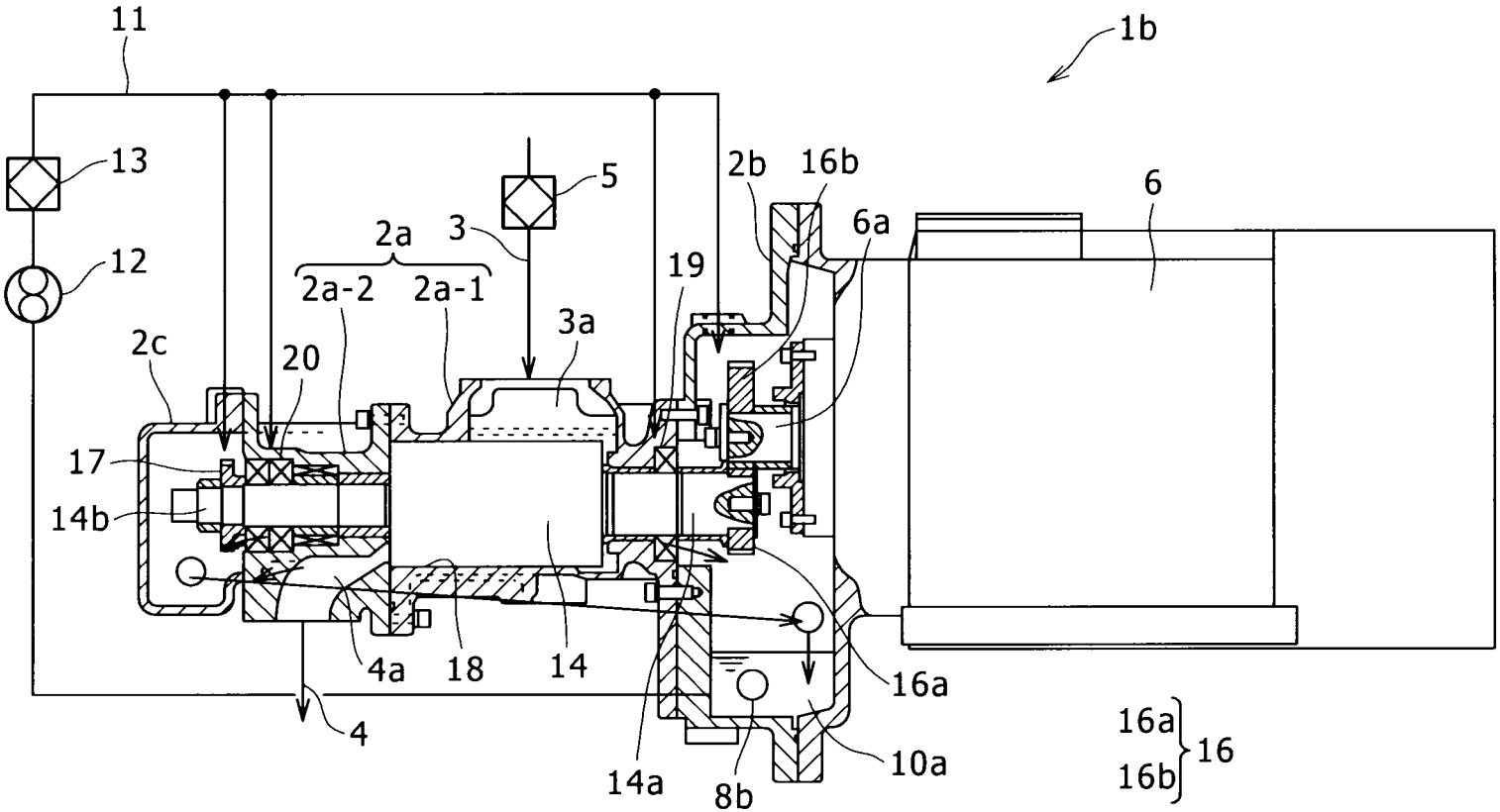
FIG. 5 is a schematic diagram viewed along an arrow B-B of FIG. 4 according to the third embodiment of this invention in which a schematic oil circulation path is additionally depicted, and FIG. 6 schematically shows a part according to a fourth embodiment of this invention in a diagram viewed from an arrow C-C of FIG. 3 in which flows of cooling water and oil are additionally depicted.

Next, referring to FIGS. 4 and 5 in the accompanying drawings, a water injection type screw compressor according to a third embodiment of this invention will be described. FIG. 4 is a plan view showing, partially in cross section, structure of the water injection type screw compressor according to the third embodiment of this invention, and FIG. 5 is schematic diagram viewed along an arrow B-B of FIG. 4 according to the third embodiment of this invention in which a schematic oil circulation path is additionally depicted.

It should be noted that the third embodiment of this invention and the previously-described second embodiment are different only in a route of the water channel 8 arranged after passing through the water cooler 9, and exactly identical in structure other than the route. Thus, an arrangement of the water channel 8 downstream from the water cooler 9 is only described below.

Specifically, in the water injection type screw compressor 1*a* according to the second embodiment of this invention, the water in the water channel 8 having been cooled by the water cooler 9 is supplied to the rotor chamber 18 after passing through the oil trap 10*a* in the timing gear case 2*c* accommodating the timing gears 17, whereas, in the water injection type screw compressor 1*b* according to the third embodiment of this invention, the water in the water channel 8 having been cooled by the water cooler 9 is directed to pass through the oil trap 10*a* in the speed increasing gear unit case 2*b* accommodating the speed increasing gear unit 16. Thus, because the speed increasing gear unit case 2*b* is also used as the housing for storing oil, the separate and independent oil tank is no longer necessary as in the case with the previous second embodiment, which can also contribute to further structural simplification.

Figure 6:
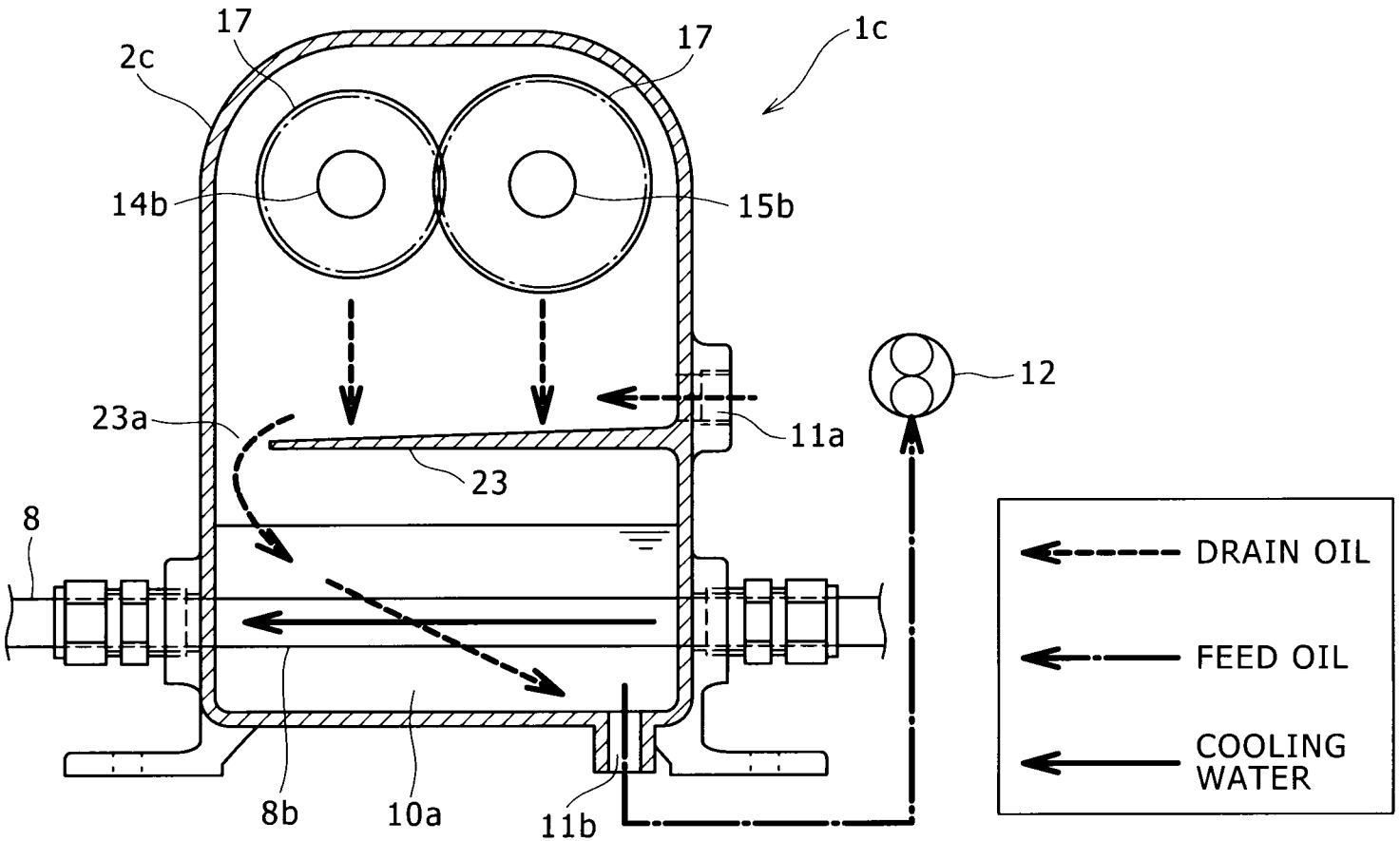

Next, a water injection type screw compressor according to a fourth embodiment of this invention will be described with reference to FIG. 6 in the accompanying drawings. FIG. 6 schematically shows a part according to the fourth embodiment of this invention in a diagram viewed from an arrow C-C of FIG. 3 in which flows of cooling water and oil are additionally depicted.

It should be noted that the fourth embodiment of this invention and the previously-described second embodiment are different only in structure of the housing for storing oil formed in the timing gear case 2*c*, and exactly identical in structure other than the housing. Thus, the structure of the housing for storing oil is only described below.

Specifically, in the water injection type screw compressor 1*a* according to the second embodiment of this invention, the housing for storing oil is formed in the timing gear case 2*c* including no protrusion on its inner wall surface, while, in the water injection type screw compressor 1*c* according to the fourth embodiment of this invention, a partitioning plate shaped member 23 placed in substantially horizontal position is disposed between the timing gears 17 and the oil trap 10*a*, and an opening 23*a* is formed between one end of the partitioning plate shaped member 23 and the inner wall surface of the timing gear case 2*c* (the housing for storing oil). Further, an oil discharge port 11*b* is formed below the other end of the partitioning plate shaped member 23 at the bottom region of the oil trap 10*a* in the timing gear case 2*c*, while the through pipe conduit 8*b* passing through the oil trap 10*a* is substantially horizontally placed within the oil trap 10*a*.

To put it another way, both discharge oil recovered by way of the discharge casing 2*a*-2 or the timing gear case 2*c* through the oil circulation channel 11 and discharge oil recovered from the speed increasing gear unit case 2*b* through the oil circulation channel 11 into an oil recovery port 11*a* fall into the oil trap 10*a* from the opening 23*a* formed on a side of the one end of the partitioning plate shaped member 23, and subsequently move toward the oil discharge port 11*b* formed below the other end of the partitioning plate shaped member 23 while being cooled by the cooling water that flows inside the through channel 8*b*. After that, the drain oil is supplied from the oil discharge port 11*b* via the oil pump 12 to where it is required. Thus, in the course of a travel toward the oil discharge port 11*b*, the drain oil dropped into the oil trap 10*a* transfers heat to the cooling water that flows inside the through channel 8*b* while intersecting the cooling water along a direction substantially orthogonal to the cooling water. This enhances cooling efficiency.

What is claimed is:

1. A water injection type screw compressor in which a sucked gas is compressed and discharged together with water as a compressed fluid, comprising:

a casing in which a rotor chamber is formed;

a pair of male and female screw rotors which are rotatably housed in the rotor chamber and rotated to compress the gas supplied into the rotor chamber;

a drive motor for causing the screw rotors to rotate;

a discharge channel through which the gas compressed in the rotor chamber flows;

a water separator disposed in the discharge channel to separate the water and the gas from the compressed fluid;

a water channel which connects the water separator to a main body of the compressor for supplying the rotor chamber with the water separated by the water separator, an oil circulation channel in which an oil pump, an oil filter, and a housing for storing oil are installed to supply the oil to where lubrication is needed, wherein a part of the water channel passes through an oil trap formed at a bottom region inside the housing for storing oil;

intermeshing timing gears which are respectively mounted on end portions of the male and female screw rotors, wherein the timing gears are retained at an upper region inside a timing gear case connected to the casing, and the housing for storing oil is the timing gear case; and a partitioning plate shaped member in the housing for storing oil, the partitioning plate shaped member being substantially horizontally disposed between the timing gears and the oil trap, wherein an opening is formed between one end of the partitioning plate shaped member and an inner wall surface of the housing for storing oil, an oil discharge port is formed below the other end of the partitioning plate shaped member at a bottom region of the oil trap in the housing, and the part of the water channel passing through the oil trap is formed of a through pipe conduit which is substantially horizontally placed in the oil trap.

2. A water injection type screw compressor in which a sucked gas is compressed and discharged together with water as a compressed fluid, comprising:

a casing in which a rotor chamber is formed;

a pair of male and female screw rotors which are rotatably housed in the rotor chamber and rotated to compress the gas supplied into the rotor chamber;

a drive motor for causing the screw rotors to rotate;

a discharge channel through which the gas compressed in the rotor chamber flows;

a water separator disposed in the discharge channel to separate the water and the gas from the compressed fluid;

a water channel which connects the water separator to a main body of the compressor for supplying the rotor chamber with the water separated by the water separator, and an oil circulation channel in which an oil pump, an oil filter, and a housing for storing oil are installed to supply the oil to where lubrication is needed, wherein;

a part of the water channel passes through an oil trap formed at a bottom region inside the housing for storing oil, wherein, along an entirety of the length of the part of the water channel that passes through the oil trap, a flow direction of oil in the oil trap is oriented in a direction substantially opposed to a flow direction of water in the part of the water channel that passes through the oil trap.

* * * * *